US007868277B2

(12) United States Patent
Lindgren

(10) Patent No.: US 7,868,277 B2
(45) Date of Patent: Jan. 11, 2011

(54) DEVICE AND METHOD FOR A SIGHT

(75) Inventor: Mikael Lindgren, Askim (SE)

(73) Assignee: SAAB AB, Linköping (SE)

( * ) Notice: Subject to any disclaimer, the term of this patent is extended or adjusted under 35 U.S.C. 154(b) by 235 days.

(21) Appl. No.: 12/153,006

(22) Filed: May 12, 2008

(65) Prior Publication Data

US 2009/0095837 A1 Apr. 16, 2009

(30) Foreign Application Priority Data

May 11, 2007 (EP) ..... 07108064

(51) Int. Cl.
*F41G 7/24* (2006.01)
*F41G 7/00* (2006.01)

(52) U.S. Cl. ..... 244/3.13; 244/3.1; 244/3.11

(58) Field of Classification Search ..... 244/3.1–3.3; 89/1.11

See application file for complete search history.

(56) References Cited

U.S. PATENT DOCUMENTS 4,014,482 A * 3/1977 Esker et al. ..... 244/3.13
4,111,383 A * 9/1978 Allen et al. ..... 244/3.13
4,111,384 A * 9/1978 Cooper ..... 244/3.13
4,111,385 A * 9/1978 Allen ..... 244/3.13
4,179,085 A * 12/1979 Miller, Jr. ..... 244/3.11
4,200,251 A 4/1980 Börjesson et al.
4,234,141 A * 11/1980 Miller et al. ..... 244/3.13
4,243,187 A * 1/1981 Esker ..... 244/3.13
4,386,848 A * 6/1983 Clendenin et al. ..... 244/3.16
4,732,349 A * 3/1988 Maurer ..... 244/3.13
4,773,754 A * 9/1988 Eisele ..... 244/3.13
5,410,398 A 4/1995 Appert et al.
6,021,975 A * 2/2000 Livingston ..... 244/3.11
6,250,583 B1 * 6/2001 Livingston ..... 244/3.13
6,343,766 B1 * 2/2002 Livingston ..... 244/3.13

FOREIGN PATENT DOCUMENTS

GB 2 345 952 A 7/2000
GB 2345952 A 7/2000

OTHER PUBLICATIONS

Norwegian Search Report, Dated Jan. 15, 2009, issued in connection with counter-part Norwegian Patent Application No. 20082815.

* cited by examiner

*Primary Examiner*—Bernarr E Gregory
(74) *Attorney, Agent, or Firm*—Venable LLP; Eric J. Franklin

(57) ABSTRACT

A sight system for guiding a missile towards a moving target by use of a guidance beam that can be used for the missile to trail the target. A first viewing device receives visible light and/or a second viewing device receives non-visible light radiating from the target. The viewing device(s) include adjustable alignment marks being aligned by use of a light source and a guidance beam detector arranged together in one common position.

30 Claims, 6 Drawing Sheets

DEVICE AND METHOD FOR A SIGHT

CROSS-REFERENCE TO RELATED APPLICATIONS

This application claims priority to European patent application 07108064.2 filed 11 May 2007.

FIELD OF THE INVENTION

The invention relates to a sight system for guiding a missile towards a target. The sight system comprises a guidance beam generator for generating a guidance beam that can be used for the missile to lock on and to trail the target. The sight system comprises a first viewing device for receiving visible light from the target and/or a second viewing device for receiving non-visible light from the target. The first viewing device comprises an adjustable first alignment mark arranged to be adjusted into alignment with an axis of the guidance beam. The second viewing device comprises an adjustable second alignment mark arranged to be adjusted into alignment with the axis of the guidance beam. The sight system comprises a collimator for aligning the first alignment mark and/or the second alignment mark with the axis of the guidance beam.

BACKGROUND OF THE INVENTION

In the field of views for missile systems using a laser guidance beam for guiding missiles, it is known to use a collimator for aligning the guidance beam with an alignment mark in a viewing device. The viewing device can be a camera or another device that continuously can detect visible or non-visible light and that can present the detected result. The alignment mark in the viewing device marks the position of the guidance beam in the viewing device so that an operator can aim the guidance beam towards a target by aiming the alignment mark towards the target accordingly. The alignment mark can be an electronically generated mark, for example in the form of a crosshair.

The collimator comprises a light detector and a number of light sources which can be detected by the viewing devices. The light sources must be able to produce visible light for the visible light viewing device and non-visible light for the non-visible light viewing device. The collimator may be fixedly attached to the sight or may be detachably attachable to the sight. In order for the sight to work it is imperative that the viewing device is calibrated to always know the trajectory of the guidance beam, i.e. the position of the guidance beam in the field of view of the viewing device has to be known. Hence, the viewing device, i.e. the alignment mark, and the lead guidance beam have to be aligned.

The problem of alignment can be solved by fixing the guidance beam in relation to the alignment mark, but this is an expensive and difficult operation because it puts high demands on both the quality of the materials used and the tolerances when manufacturing the sight.

Another solution to the problem of aligning is to use an adaptive/active collimator that can continuously adjust the alignment mark to the guidance beam. In the latter case it is known to use a detector for detecting an axis of symmetry of the guidance beam and a number of visible and non-visible light sources positioned at predetermined positions around the detector. The known positions of the light sources allow for calculation of the position of the alignment mark in relation to the axis of symmetry of the guidance beam. For this solution to work, a number of calculations have to be made, which consumes energy and computing recourses. Furthermore, the positions of the light sources relative the detector have to be known accurately, otherwise the alignment mark will be misaligned. The accuracy of the positions puts high demand on the parts involved in the assembly and the assembly operation itself.

Hence, there is a need for an alternative solution to the above, where the number of calculations can be lessened and where the assembly of the sight and collimator can be done in a more simple and robust way.

SUMMARY OF THE INVENTION

The invention refers to a simple and robust solution for a sight system and a method for alignment of the sight system.

The invention relates to a sight system for guiding a missile towards a moving target. The sight system comprises a guidance beam generator for generating a guidance beam that can be used for the missile to trail the target.

The guidance beam generator advantageously produces a laser beam that is brought to alternately sweep in at least two perpendicular directions and thereby create the guidance beam. The axis of symmetry of the guidance beam is important for the system since the missile can follow the guidance beam by use of a radiation detector as long as it is within the corridor created by the guidance beam. By knowing the axis of symmetry of the guidance beam an operator of the sight system can aim and point the axis of symmetry of the guidance beam towards the target and thereby giving the missile a maximum freedom of movement within the guidance beam.

In order to be able to aim and point, the sight system comprises a first viewing device for viewing the target using visible light. The system advantageously also comprises a second viewing device for observing the target using non-visible light. It should be noted that the invention can be used on the first viewing device when used alone and the second viewing device when used alone, or when both the first and second viewing devices are used at the same time. Furthermore, additional viewing devices may be added to the system and use the invention accordingly. The first viewing device may be a camera that can observe the target during daylight or an optic sight. The second viewing device may be a camera that can observe the target during reduced visibility. The second viewing device may be a camera for non-visible light. The second viewing device may, for example, be a heat sensitive viewing device such as an infrared camera. The non-visible light may thus be an infrared light that radiates from a warm object. However, the non-visible light could also be a non-visible light having a different wavelength than infrared, for example ultraviolet light.

The first viewing device comprises an adjustable first alignment mark that is arranged to be adjusted into alignment with an axis of the guidance beam. The second viewing device comprises an adjustable second alignment mark arranged to be adjusted into alignment with the axis of the guidance beam. The sight system also comprises a collimator for aligning the first alignment mark and/or the second alignment mark with the axis of the guidance beam. When the system is aligned, the alignment mark(s) can be made visible to the operator on the viewing device(s), for example as a crosshair, so that the operator easily can aim, point and follow a selected target or the light source itself may act as an alignment mark.

Here "aligning" refers to a method for bringing the alignment mark into a position in the viewing device so that the line of sight between the alignment mark and the target is collinear with the axis of the beam, i.e. the line of sight is parallel and in alignment with the axis of the guidance beam and also centred about the same axis as the axis of the beam. However, the invention is not limited to an exact alignment in the sense that it has to be identical, but small variations may be allowed within selected tolerances, i.e. prerequisites, for the function of the sight system.

The invention is characterized in that the collimator comprises a light source and a guidance beam detector arranged together in one common position. By having the light source and the detector in a common position the calculations made in prior art for finding the position of the detector relative the light sources can be eliminated. Furthermore, the assembly of the collimator can be done easily since there is only one position for the combination to consider.

The guidance beam detector is arranged to detect the guidance beam for calculating the position of the axis of the guidance beam in relation to the detector. The system comprises a control unit that communicates with the guidance beam generator and the collimator for calculating the position of the guidance beam detector in relation to the axis of the guidance beam. The guidance beam generator is known in prior art, for example, U.S. Pat. No. 4,200,251, and will only be discussed briefly. The guidance beam generator transmits a beam of rays, e.g. laser radiation, in the direction towards the target. Before the beam of rays leaves the sight system a number of mirrors are used for guiding the beam to the collimator and to a mirror that can be aimed, i.e. that can be altered by a user in order to reflect the guidance beam towards the target. The beam of rays has an axis which is important to detect in order to be able to create and present a visible alignment mark that represents the axis to a user The control unit is fed information from the guidance beam generator regarding the time it takes for the rays to sweep the area covered by the beam. The area of the sweep is also known which makes it possible to calculate the speed in which the ray sweeps. The control unit is also fed information from the collimator regarding when the guidance beam detector has detected that the ray has hit the guidance beam detector. The calculation can be explained as the control unit starting a clock when the rays start sweeping and stops the clock when the guidance beam detector has detected the ray. If the time period for detecting the ray is exactly half the sweep time, the detector is aligned with the axis of symmetry. However, if the measured time differs from half the sweep time the detector is offset and the difference in time can be used for calculating the distance between the midpoint of the sweep and the position of the detector. After the ray has swept in a number of directions and thereby creating the guidance beam, the position of the detector in the beam can be calculated according to above.

In one embodiment of the invention, the alignment of the first alignment mark and/or the second alignment mark may be done by moving the alignment mark(s) into a position being aligned with the axis of the guidance. In this embodiment, the alignment mark(s) can be represented by an alignment mark symbol being displayed in the viewing device or in a display unit being connected to or part of the viewing device. The light source is detected by the first and/or the second viewing device and is used to position the alignment mark(s) in a position relative the detected light source so the alignment mark becomes aligned with the axis of the guidance beam.

In another embodiment of the invention, the light source itself is the alignment mark and the first alignment mark is the visible light source and the second alignment mark is the non-visible light source. The alignment of the first alignment mark and/or the second alignment mark may be done by moving the guidance generator into a position so that the beam detector/light source assembly is aligned with the axis of the guidance beam; or by moving the beam detector/light source assembly into a position being aligned with the axis of the guidance beam. The alignment mark(s) may be presented to an operator by introduction of an alignment mark symbol (s) that is positioned in the position of the alignment mark(s). The alignment mark symbol may be made visible in the first and/or the second viewing device; or in a display unit connected to the first and/or the second viewing device; or in one or more display units being part of the first and/or the second viewing device.

The control unit may thus be arranged to communicate with the first viewing device and/or the second viewing device for adjusting the first alignment mark and/or the second alignment mark, i.e. e.g. the alignment mark symbol, into alignment with the axis of the guidance beam after the control unit has made the above described calculations. The control unit may also be arranged to adjust the position of the beam detector/light source assembly and/or the guidance beam generator for alignment of the beam detector/light source assembly, i.e. the first alignment mark and/or the second alignment mark, into alignment with the axis of the guidance beam.

The control unit may be a computer or any other suitable system that can handle signals and make calculations. The signals may be optical, electrical, sound waves, etc. and the control device may comprise suitable equipment accordingly. The control unit may be one unit connected to all parts of the sight system, or may comprise a number of units, connected in different known ways to a number of different parts in the sight system, thereby creating a network. The control unit may be connected to the different parts in the system via electrical cords, or may use a wireless connection.

The light source is arranged to be detected in the first viewing device and/or in the second viewing device so that the symbol of the first alignment mark and/or the second alignment mark may be positioned in alignment with the axis of the guidance beam. The axis is preferably the axis of symmetry for the reasons stated above when describing prior art.

In one embodiment of the invention, the light source comprises a visible light source producing light with a wavelength that can be detected by the first viewing arrangement and/or a non-visible light source producing light with a wavelength that can be detected by the second viewing device. One advantage is that the guidance beam detector is positioned in a position common for all light sources, which minimizes the number of calculations during alignment.

In one advantageous embodiment, the light source and the guidance beam detector is a photodiode that is arranged to produce visible light and/or non-visible light when biased in one direction and arranged to detect light when biased in the opposite direction. The use of a diode as a detector for light is known from prior art. If the diode cannot produce enough heat in order to function as a non-visible light source, the diode may be fitted in a unit comprising a heat generating device, for example an electrical resistor or the like. The position of the resistor should coincide with the position of the diode during alignment in order to minimize the number of calculations. The stacking of the diode and the light source(s) should thus be made in a direction perpendicular to the cross-section of the guidance beam, i.e. in the guidance beam direction.

The non-visible light source is a heat radiation device. The heat radiation can be heated by any known means, for example by use of an electric resistance device.

The sight system comprises a mirror arrangement arranged to guide the guidance beam from the guidance beam generator to the detector in the collimator and arranged to guide the light from the light source in the collimator to the first viewing device and/or the second viewing device.

The mirror arrangement may also be arranged to guide the guidance beam from the guidance beam generator to an exit opening in the sight system so that the guidance beam can be directed towards the target.

The mirror arrangement may also be arranged to guide light radiating from the target to the first viewing device and/or the second viewing device. The arrangement of mirrors is known from prior art and may be done in a number of different ways as long as the guidance beam can be directed towards the target and as long as the system operator can detect the target and point the guidance beam towards the target with the aid of the viewing device(s) by use of a correctly collimated alignment mark.

In order for the system to function, at least some mirrors are partially reflective mirrors, i.e. mirrors that reflect a part of the light and allow passage of a remaining part of the light. An example of such a mirror is a dichroic mirror, which is a mirror that reflects a certain wavelength range and transmits the remaining wavelength ranges The sight system may comprise a symbol generator for generating one or more symbols representing the first alignment mark and/or the second alignment mark. The symbol generator may be comprised in the control unit or may be a separate unit connected to the units comprised in the system. The symbol generator may be a computer or the like that produces the alignment mark symbol that can be presented to the system operator via the viewing device (s) or another unit that can display the alignment mark(s) symbols and the target.

The control unit may thus be arranged to control the symbol generator to present the first alignment mark (symbol) in the correct position in the first viewing device and arranged to control the symbol generator to present the second alignment mark (symbol) in the correct position in the second viewing device.

The control unit may thus be arranged to control the position of the first alignment mark in the first viewing device and/or the second alignment mark in the second viewing device dependent on the calculations of the position of the beam detector relative the guidance beam axis.

The control unit may also be arranged to pass an image from the first viewing device and/or an image from the second viewing device to a remote display unit. The remote display unit may be a computer screen, television screen or any other screen or unit that can present images. The control unit may also be arranged to control the symbol generator to produce the first and/or the second alignment mark on the display unit so that the system operator can position the present alignment mark in the target comprised in the image for directing the guidance beam at the target.

The control unit may also be arranged to pass the image from the second viewing device to a single display unit being used by the first viewing device to aid in directing the guidance beam at the target under conditions of reduced visibility. The display unit may here be the ocular when the first viewing device is an optical sight.

In order to make it possible to aim against a target in darkness, fog or smoke, the second viewing system uses the non-visible light, i.e. e.g. infrared light that radiates from the target. The non-visible light source is then used for aligning the second alignment mark with the axis of the beam in the second viewing device in the same manner as the visible light source is used for aligning the first alignment mark with the guidance beam in the first viewing device.

The guidance beam is advantageously electromagnetic radiation in the form of a laser beam that scans over a selected area. The selected area is the cross-section of the guidance beam. The sweep frequency of the laser may vary dependent on the detector device on the missile.

In another embodiment of the invention, the calculation of the misalignment between the guidance beam detector and the axis of symmetry of the guidance beam in the collimator is made according to the above, but the position of the guidance beam generator may be controlled and altered so that the axis of symmetry becomes aligned with the guidance beam detector.

In yet a further embodiment of the invention, the calculation of the misalignment between the guidance beam detector and the axis of symmetry of the guidance beam in the collimator is made according to the above, but the position of the guidance beam detector may be controlled and altered so that the axis of symmetry becomes aligned with the guidance beam detector In both the latter embodiments, the guidance beam detector is always aligned with the axis of symmetry of the guidance beam. One benefit of these embodiments is that the alignment mark is automatically presented in the viewing device(s) in a position being aligned with the axis of symmetry of the guidance beam since the position of the light source(s) is the same as the position of the guidance beam detector and thus aligned with the axis of the guidance beam. Hence, a further advantage is that the projection of the light source itself can act as a symbol/alignment mark in the viewing device(s). This makes the system more robust and easy to use should the symbol generator fail and less expensive should the symbol generator be opt out. Yet furthermore, the calculations are simplified since the control unit only has to control the device that is to be adjusted so that the misalignment becomes zero. This can be done by measuring time. For example, by knowing the sweep time it is sufficient to use half the sweep time as a reference value and to adjust the beam detector/light source and/or the guidance beam generator accordingly.

BRIEF DESCRIPTION OF DRAWINGS

The invention will below be described in connection to a number of drawings, in which:

FIG. 4*b* schematically shows a display unit displaying a target and an alignment mark before and after alignment, and in which;

DETAILED DESCRIPTION OF EMBODIMENT(S) OF THE INVENTION

Figure 1:
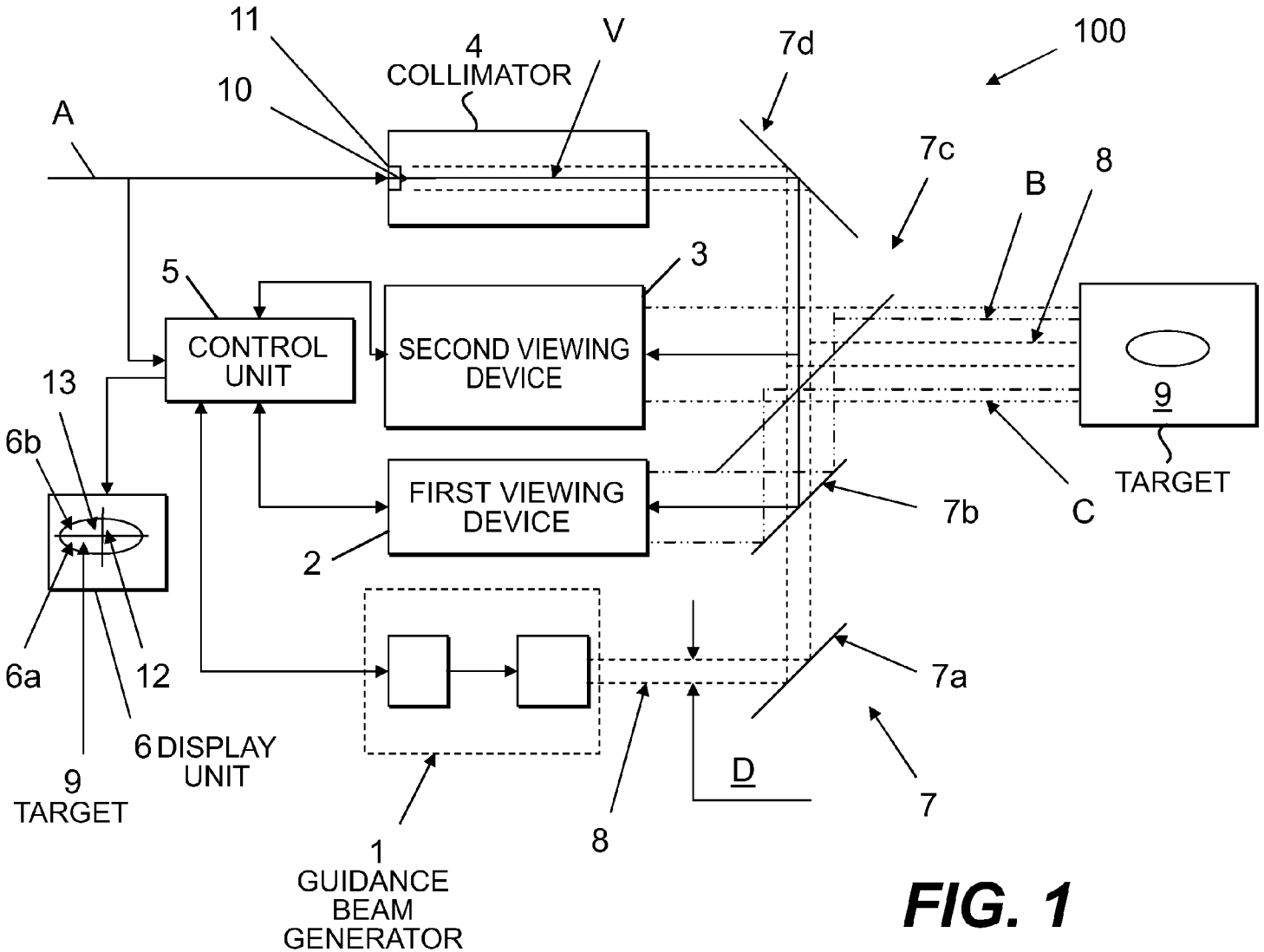
FIG. 1 schematically shows a sight system according to a first embodiment of the present invention.

FIG. 1 schematically shows a sight system 100 according to a first embodiment of the present invention. The sight system 100 comprises a guidance beam generator 1, a first viewing device 2, a second viewing device 3, a collimator 4, a control unit 5, a display unit 6 and a mirror arrangement 7. The guidance beam generator 1 generates a guidance beam 8 that is transmitted towards a target 9 via the mirror arrangement 7. In FIG. 1 the travelling path of the guidance beam is depicted with two parallel broken lines. The guidance beam generator 1 generates a ray of light, preferable laser light, and brings the ray to sweep over a selected cross-sectional area. The sweeping frequency is high enough to create the guidance beam 8 having a cross-section identical to the cross-sectional area. The distance D between the two broken lines is the width of the cross-section of the guidance beam 8. The cross-section of the guidance beam 8 is preferably circular, but may have any other suitable shape, for example oval, square or polygonal. The width D of the guidance beam is determined by the sweep of the laser ray generated in the guidance beam generator 1.

In FIG. 1, the guidance beam generator 1 generates a guidance beam 8 that is transmitted towards a first mirror 7*a*. The first mirror 7*a* reflects the guidance beam 8 towards a second mirror 7*b* being partly reflective, for example dichroic. The second mirror 7*b* is selective in such a way that the guidance beam can travel through the mirror while light with another frequency is reflected. In FIG. 1 visible light is reflected. The guidance beam then passes a third partly reflective, (e.g. dichroic) mirror 7*c* and is reflected by a fourth mirror 7*d* into the collimator 4. The third mirror 7*c* is selective in such a way that the guidance beam is reflected in its main part. For example, about 1% of the guidance beam is allowed to pass through to the fourth mirror 7*d*. The third mirror 7*c* is arranged so that infrared light (or another suitable non-visible light) can pass the mirror and such that visible light can be reflected. The mirror arrangement 7 is not limited to the arrangement described in FIG. 1, but may comprise more or less mirrors as long as the function of the sight system is maintained. For example, the first mirror 7*a* may be opt out and the guidance beam generator 1 may be positioned so that the guidance beam 8 is directed directly through the second mirror 7*b*. The fourth mirror 7*d* may also be opt out if the collimator 4 is positioned so that the guidance beam 8 can enter the collimator without a mirror. However, the arrangement in FIG. 1 allows for a compact sight system, which is advantageous since the system should be able to be transported by a person and/or a means for transport.

In FIG. 1 a first operating window of the first viewing device 2 is depicted with two parallel broken lines comprising a repeated sequence of a dash and two consecutive dots. The first operating window refers to the first viewing device 2 being able to receive visible light B from the target 9 within a selected geometrical area. The visible light B is fed to the first viewing device 2 via the third mirror 7*c* and the second mirror 7*b*. As been explained above, both the second and third mirror 7*b*, 7*c* are arranged to reflect visible light. Hence, by using the first viewing device 2, an operator may see the target via the mirror arrangement 7. The first viewing device 2 may be an optical device such as a telescope for direct viewing, or may be an electronics device such as a camera that registers the visible light and presents a visible image 6*a* to the operator or sends the image 6*a* in the form of a signal to the control unit 5 and the display unit 6. The control unit 5 may also be arranged to pass the image 6*a* on to the display unit 6.

In FIG. 1 a second operating window of the second viewing device 3 is depicted with two parallel broken lines comprising a repeated sequence of a dash and one dot. The second operating window refers to the second viewing device 3 being able to receive non-visible light C from the target 9 within a selected geometrical area. The non-visible light may be infrared light radiating from the target due to the target being warm. The non-visible light C is fed to the second viewing device 3 through the third mirror 7*c*. As been explained above, both the third mirror 7*c* is arranged to reflect visible light B and the most part of the guidance beam 8, but to allow passage of non-visible light of a different frequency. Hence, by using the second viewing device 3, an operator may see the target via the mirror arrangement 7 even during non-visible conditions, i.e. e.g. smoky, foggy, or dark conditions. The second viewing device 3 may be an electronics device, such as an infrared camera, that registers the non-visible light and presents a visible image 6*a* to the operator or sends the image 6*a* in the form of a signal to the control unit 5 and the display unit 6. The control unit 5 may also be arranged to pass the image 6*a* on to the display unit 6.

The collimator 4 comprises a guidance beam detector 10 and a light source 11. The guidance beam detector 10 and the light source 11 are positioned in a common position. Here common position refers to a position along a common axis A having an extension in the travelling direction of the incident guidance beam in the collimator. This means that the guidance beam detector 10 and the light source 11 coincide in one point in a plane being parallel to the cross-sectional plane of the guidance beam.

The guidance beam detector 10 detects when the sweeping ray passes the guidance beam detector 10 and passes on information to the control unit 5. The control unit 5, or a separate calculating means connected to the control unit, calculates the misalignment between the position of the guidance beam detector 10 and the symmetrical axis of the guidance beam 8.

When the light source 11 is turned on the light from the light source travels along a path V depicted in FIG. 1 with a solid line. It should be noted that the light source can produce visible light to be used by the first viewing device 2 and/or non-visible light to be used by the second viewing device 3.

When the light source 11 produces visible light, the path V is described by the light being reflected by the fourth mirror 7*d* towards and through the third mirror 7*c* to the second mirror 7*b* where the light is reflected into the first viewing device 2. In the first viewing device 2, the received light from the light source 11 is used for identifying the position of the light source 11 in the image 6*a* presented or produced in the first viewing device. The position of the light source 11 in the image 6*a* is then used together with the calculation of the misalignment between the position of the guidance beam detector 10 and the symmetrical axis of the guidance beam 8 for finding the position of the symmetrical axis of the guidance beam in the image 6*a*. The first alignment mark 12 may be produced in a symbol generator (not shown). The first alignment mark 12 may be presented as a symbol in the form of a crosshair or any other suitable symbol that can be used for aiming the sight, i.e. the guidance beam 8, against the target 9. The control unit 5 controls the symbol generator so that the first alignment mark 12 is positioned in the image 6*a* in the position of the symmetrical axis of the guidance beam 8. The symbol generator may be a part of the first viewing device 2 or a part of the control unit 5 or may be a separate unit connected to the control unit and the first viewing device 2 and controlled by the control unit 5. As mentioned before, by using the first viewing device 2, an operator may see the target via the mirror arrangement 7 and may due to the alignment mark 12 be able to position the symmetrical axis in the target. The first viewing device 2 may be an optical device such as a telescope for direct viewing, or may be an electronics device such as a camera that registers the visible light and presents a visible image 6*a* to the operator or sends the image 6*a* in the form of a signal to the control unit 5 and the display unit 6. The image 6*a* may also be sent only to the control unit which is arranged to pass the image 6*a* on to the display unit 6. In all cases the first alignment mark 12 (and thus the alignment mark symbol) is aligned with the symmetrical axis in the displayed image 6*a* according to above.

The benefit of the invention lies in the simple calculations due to the common position of the light source 11 and the guidance beam detector 10.

When the light source 11 produces non-visible light, the path V is described by the light being reflected by the fourth mirror 7*d* towards the third mirror 7*c* where the light is reflected into the second viewing device 3. In the second viewing device 3, the received light from the light source 11 is used for identifying the position of the light source 11 in an image 6*b* presented or produced in the second viewing device 3. The position of the light source 11 in the image 6*b* is then used together with the calculation of the misalignment between the position of the guidance beam detector 10 and the symmetrical axis of the guidance beam 8 for finding the position of the symmetrical axis of the guidance beam in the image 6*b*. The second alignment mark 13 may be produced in a symbol generator (not shown). The symbol may be a crosshair or any other suitable symbol that can be used for aiming the sight against the target. The control unit 5 controls the symbol generator so that the second alignment mark 13 is positioned in the image 6*b* in the position of the symmetrical axis of the guidance beam 8. The symbol generator may be a part of the second viewing device 3 or a part of the control unit 5 or may be a separate unit connected to the control unit 5 and the second viewing device 3 and controlled by the control unit 5. As mentioned before, by using the second viewing device 3, an operator may see the target via the mirror arrangement 7, even during non-visible conditions, and may due to the alignment mark be able to position the symmetrical axis' in the target. The second viewing device 3 may be an electronics device such as an infrared camera that registers the non-visible light and presents a visible image 6*b* to the operator or sends the image 6*b* in the form of a signal to the control unit 5 and the display unit 6. The image 6*a* may also be sent only to the control unit which is arranged to pass the image 6*a* on to the display unit 6. In all cases the second alignment mark 13 is aligned with the symmetrical axis in the displayed image 6*a* according to above.

It should be noted that the invention is not limited to the generation of two different alignment mark symbols, but the symbol generator may produce only one alignment mark symbol used in both the first and the second viewing devices 2, 3 and/or in the display unit 6.

Furthermore, the light source 11 may be arranged to emit both visible light and non-visible light at the same time. Both the visible light source and the non-visible light source are positioned in a common position on the above described axis A with the above described advantages with regard to calculation.

In another embodiment of the invention, the light source 1 itself is used as an alignment mark. The first and second alignment marks 12, 13 are comprised in the first and second viewing devices 2, 3 respectively since the light source 11 is detected and projected in the first and second viewing devices 2, 3. The control unit 5 may then be arranged to control the position of the guidance beam generator 1 and/or the guidance beam detector 10 in such a way that the light source 11 is positioned in alignment with the axis of the guidance beam 8. Here, the first alignment mark 12 is the visible light source and the second alignment mark 13 is the non-visible light source. Here, the symbol generator may be used to position an alignment mark symbol in the first viewing device 2 and/or the second viewing device 3 in a position corresponding to the position of the light source 11 detected/presented in the first viewing device 2 and/or the second viewing device. It should be noted that the light from the light source 11 being visible in the first viewing device 2 and/or the second viewing device can be used as an alignment mark symbol, since the light source produces a visible dot that can be used for aiming at the target. A display unit 6 can be connected to or be comprised in the first viewing device 2 and/or the second viewing device for presentation of an alignment mark symbol and an image of the target.

The sight system may comprise a housing (not shown) encompassing all or some of the described units. The housing may then have an opening (not shown) through which the guidance beam, the visible light B and the non-visible light is guided to the mirror arrangement 7.

Figure 2:
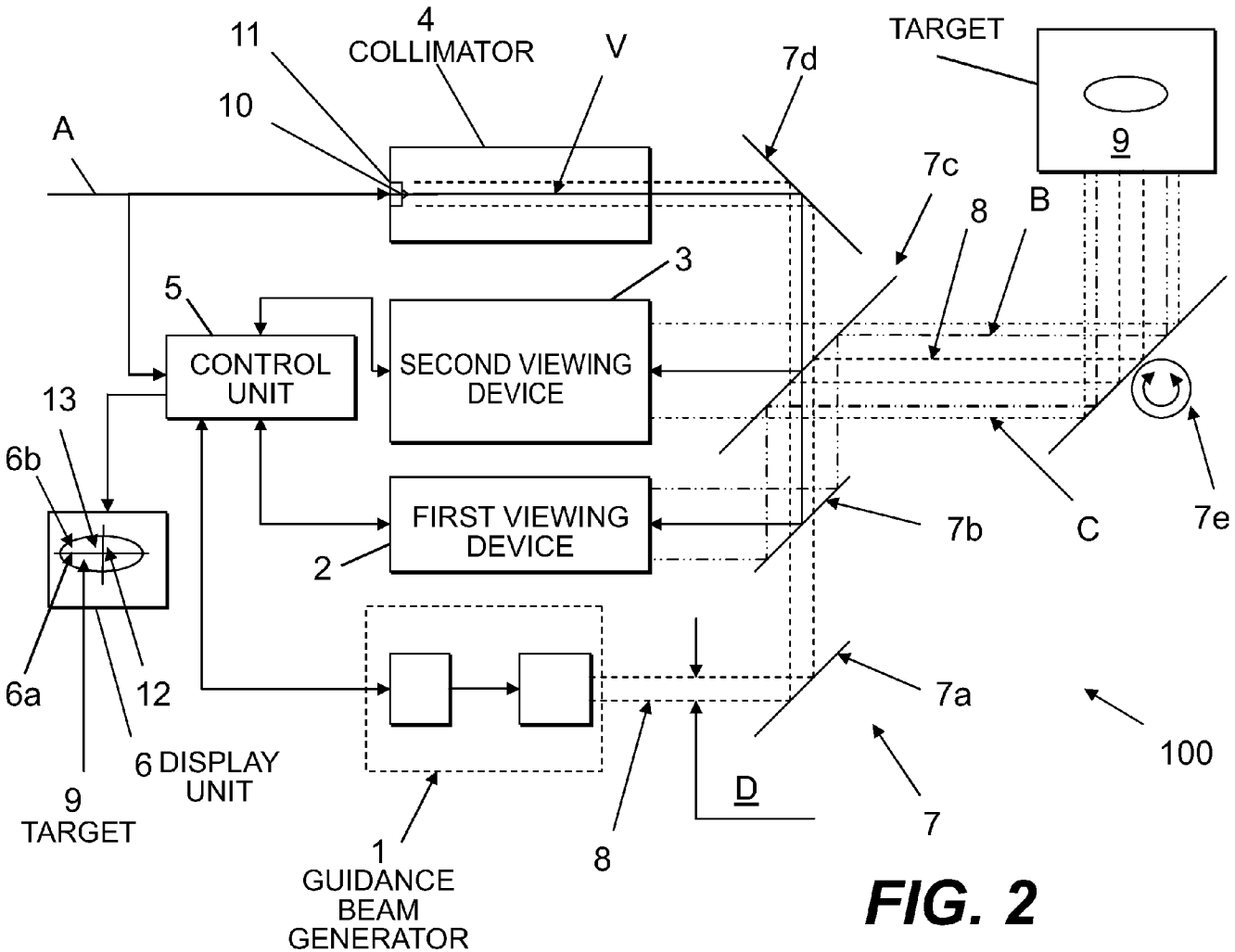
FIG. 2 schematically shows a sight system according to a second embodiment of the present invention.

FIG. 2 schematically shows a sight system according to a second embodiment of the present invention. The embodiment in FIG. 2 is identical to the embodiment in FIG. 1, but with the difference that the mirror arrangement comprises a fifth minor 7*e* positioned between the target 9 and the other mirrors 7*a*-7*d*. The fifth mirror 7*e* is adjustable and can reflect both visible and non-visible light. The adjustable fifth minor 7*e* may be used for directing the guidance beam 8 towards the target by moving the fifth mirror 7*e*. The adjustable minor also allows for trailing a moving target by altering the position of the fifth minor 7*e*. As is obvious from FIG. 2, the first viewing device 2 and the second viewing device operate with line of sights being aligned with the guidance beam. Here, "lines of sight" refers to the first operating window and the second operating window as described in connection to FIG. 1. The lines of sight can be seen as depicted by the parallel lines B and C.

Figure 3:
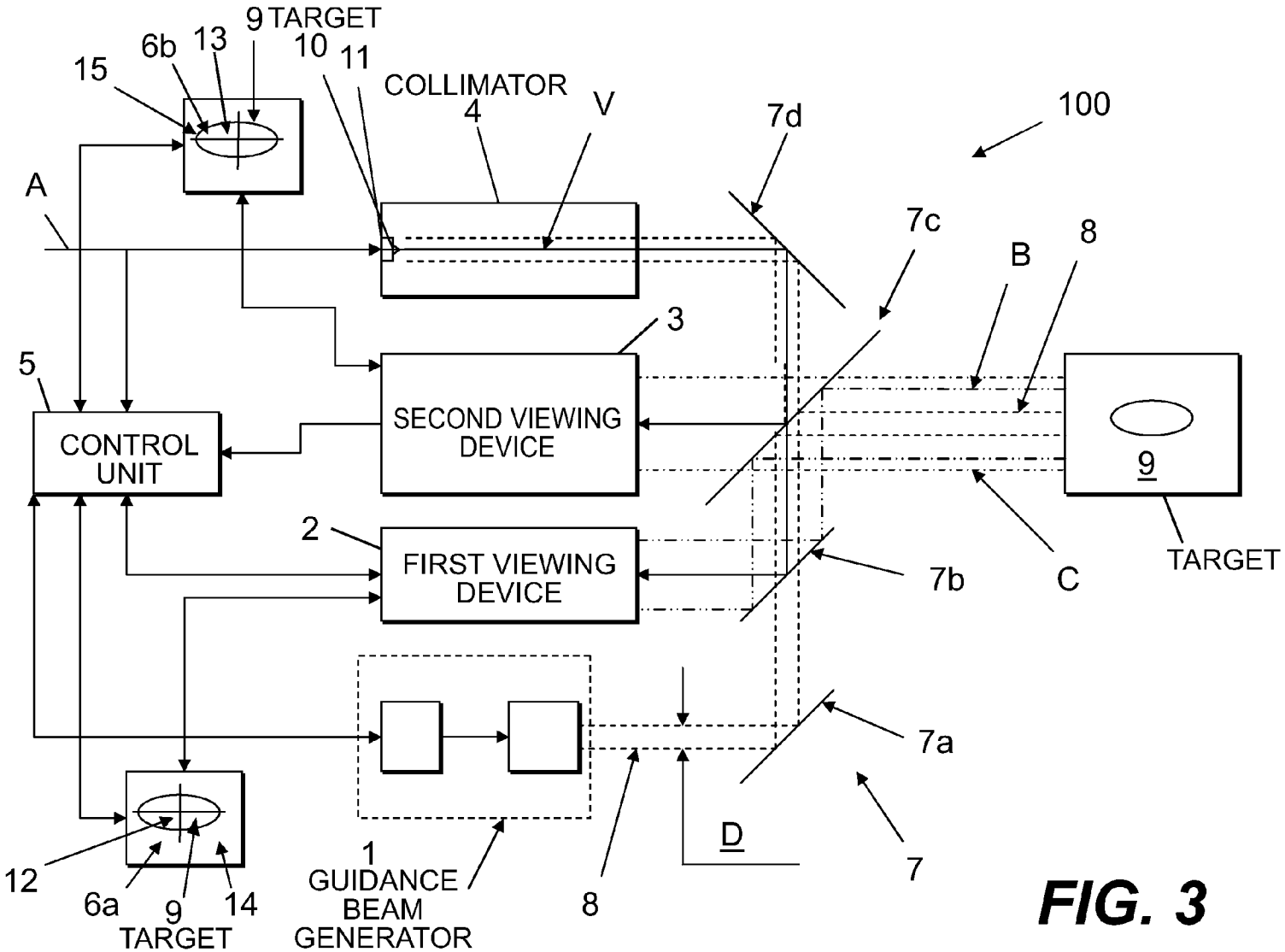
FIG. 3 schematically shows a sight system according to a third embodiment of the present invention.

FIG. 3 schematically shows a sight system according to a third embodiment of the present invention. The embodiment in FIG. 3 is identical to the embodiment in FIG. 1, but with the difference that the display unit (reference no 6 in FIGS. 1 and 2) comprises a first display unit 14 for the first viewing device 2 and a second display unit 15 for the second viewing device 3. The first display unit 14 shows the first image 6*a* and the second display unit 15 shows the first image 6*b*.

Figure 4B:
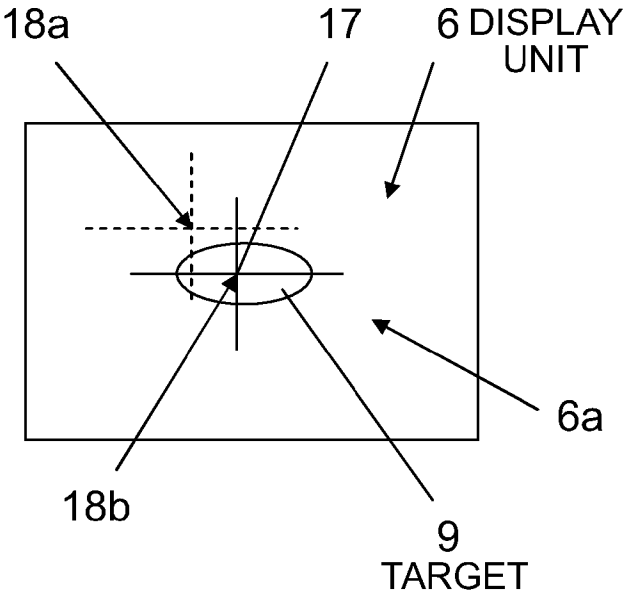
Figure 4A:
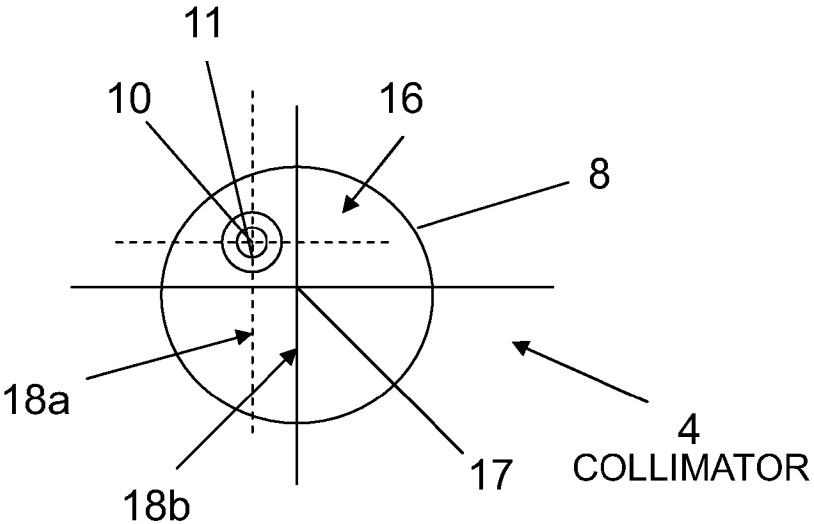
FIG. 4*a* schematically shows a part of the inside of the collimator comprising the guidance beam detector.
Figure 4C:
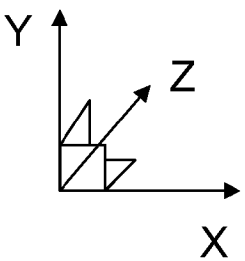
FIG. 4*c* shows the axes of orientation of FIGS. 4*a* and 4*b;*

FIG. 4*a* schematically shows a part of the inside of a collimator 4 according to the invention comprising the guidance beam detector 10 and the light source 11 being positioned in a common position. In FIG. 4*a* is shown a circular plane 16 having an extension in an X-Y-plane as illustrated in FIG. 4*c*, and being positioned perpendicular to the axis of symmetry 17 of the guidance beam 8. In the collimator 4, the axis of symmetry 17 has an extension in a Z-direction being perpendicular to the plane 16. The guidance beam detector 10 and the light source 11 is positioned in the plane 16 or at least at the same position in the plane, i.e. they can have a different position in the direction of travel of the guidance beam 8. In FIG. 4*a* the axis of symmetry 17 is misaligned with the guidance beam detector 10.

In FIG. 4*a* is shown an alignment mark 18*a* and 18*b* that can symbolise the first and/or the second alignment marks in FIGS. 1-3. FIG. 4*a* also shows that the alignment mark 18*a* is drawn with broken lines when the centre (crossing point of the two lines) of the alignment mark 18*a* coincides with the position of the guidance beam detector and that the alignment mark 18*b* is drawn with solid lines when the centre (crossing point of the two lines) of the alignment mark 18*b* coincides with the position axis of symmetry 17 of the guidance beam 8. It is obvious that the alignment mark 18*a* does not represent the position of the axis of symmetry 17 of the guidance beam 8. Therefore, either the alignment mark 18*a* has to be moved into the correct position 18*b* or that the alignment mark 18*b* has to be moved into the correct position. Here, "correct position" refers to the position of the axis of symmetry 17.

Here, correct position is achieved when alignment mark 18*a* coincide with alignment mark 18*b*. Hence, the alignment mark 18*a* may be moved to the position of the alignment mark 18*b* without moving the detector 10 or the axis of symmetry 17; or the detector 10 and light source 11 can be moved to a position where the alignment mark 18*a* and the alignment mark 18*b* coincide, i.e. where the alignment mark 18*a* is positioned in alignment with the axis of symmetry 17; and/or the axis of symmetry 17 can be moved to a position where the alignment mark 18*b* and the alignment mark 18*a* coincide, i.e. where the alignment mark 18*b* is positioned in alignment with the detector 10 and the light source 11.

FIG. 4*b* schematically shows a display unit 6 displaying an image 6*a* comprising a target 9 and an alignment mark 18*a* before alignment and an alignment mark 18*b* after alignment of the alignment mark 18*a* with the axis of symmetry 17 of the guidance beam. In FIG. 4*b* it is obvious that the sight system cannot operate without the collimator according to the invention, because the axis of symmetry 17 will be off target and the missile will consequently miss its target.

Figure 5:
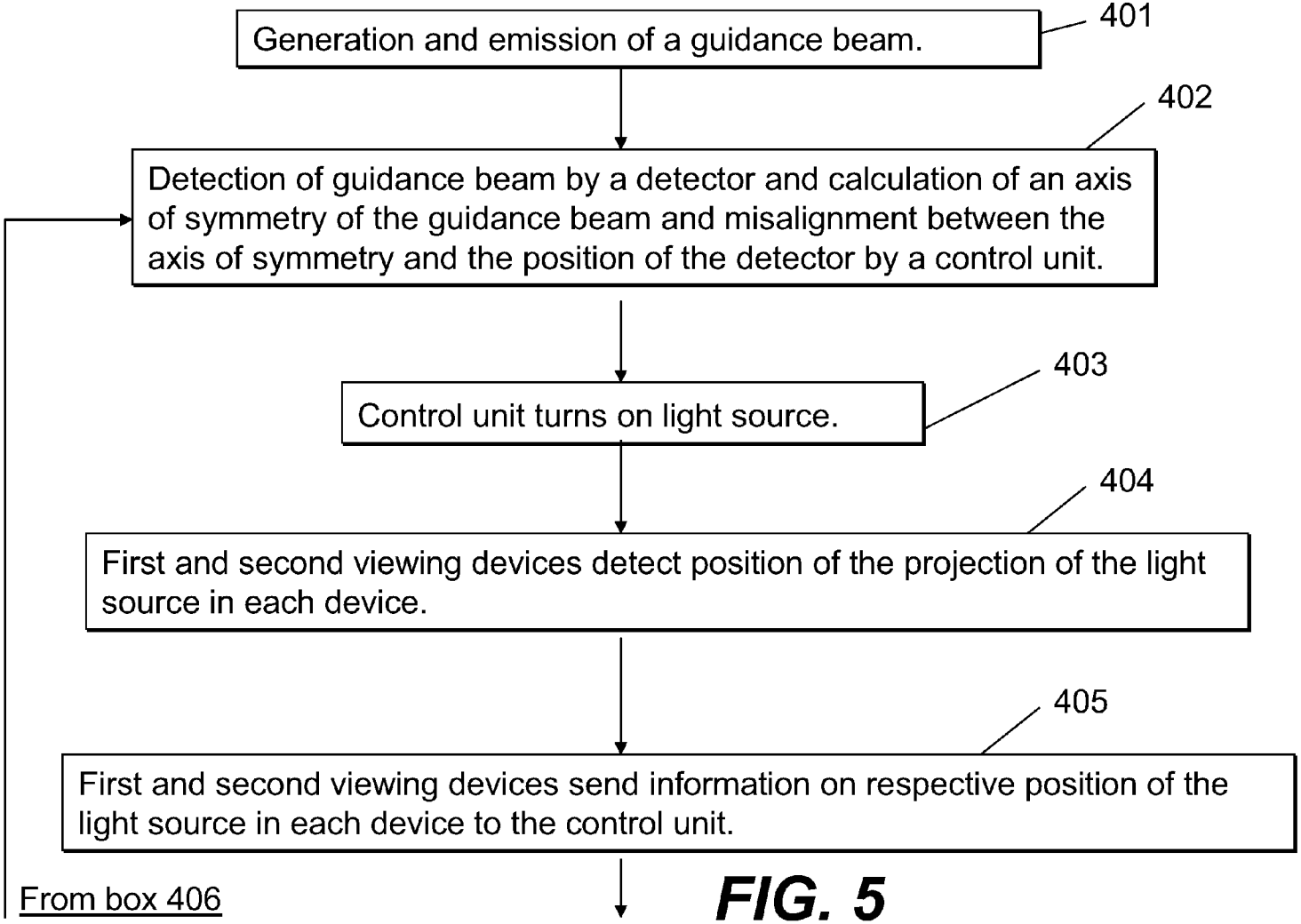
FIGS. 5-6 schematically teach a flow chart of a method for aligning the sight system according to the invention.
Figure 6:
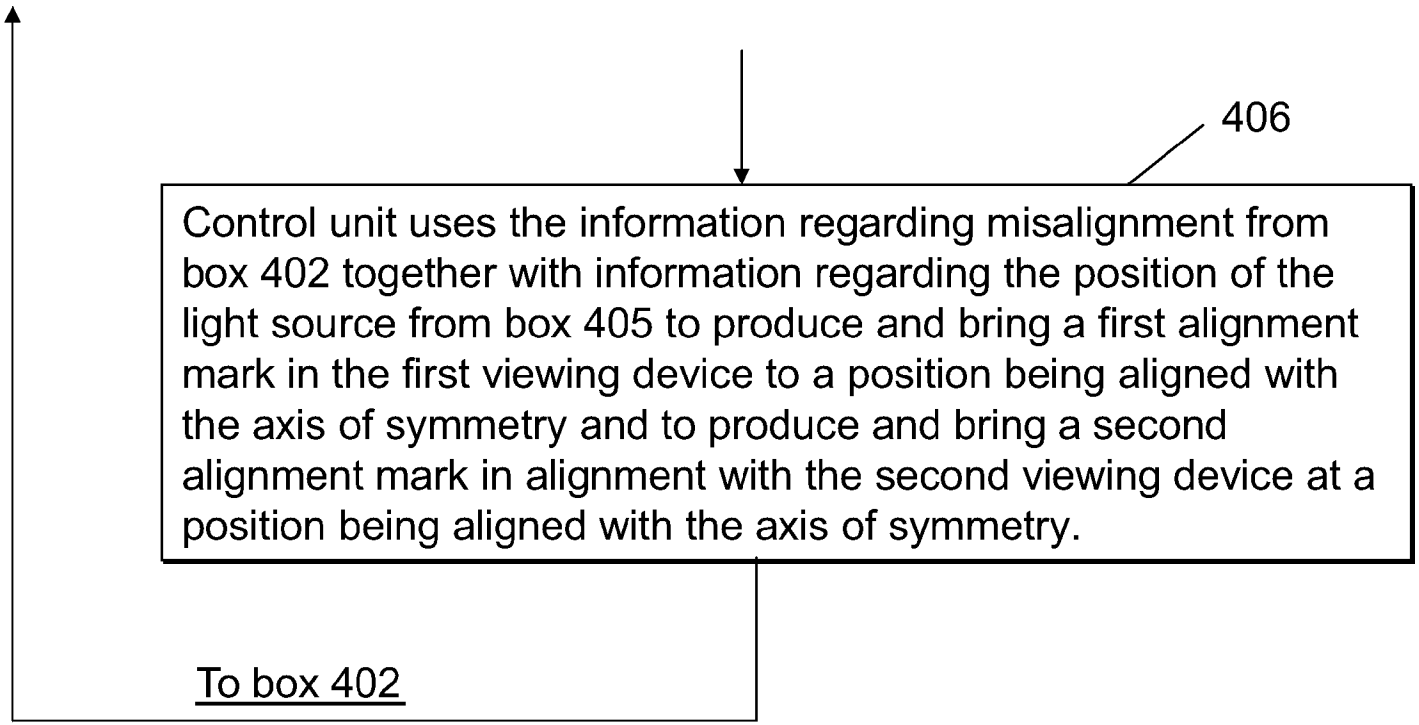

FIGS. 5-6 schematically teach a flow chart of a method for aligning the sight system according to the invention. The method described in connection to FIGS. 5-6 shall be read together with the description of FIGS. 1-4 and it should be noted that the method of alignment can be any of the previous described methods or may be a combination.

401

The guidance beam generator generates and emits a guidance beam.

402

The guidance beam detector detects the guidance beam and the control unit, or any other suitable device, calculates the position of the axis of symmetry of the guidance beam and the misalignment between the axis of symmetry and the position of the detector.

403

The control unit turns on the light source. The light source may also be turned on before box 402 and may be turned on continuously or intermittently.

404

The first and second viewing devices detect the position of the presentation of the light source in each device.

405

The first and second viewing devices send information on respective position of the light source in each device to the control unit.

406

The control unit uses the information regarding misalignment from box 403 together with information regarding the position of the light source from box 405 to produce a first alignment mark in the first viewing device at a position being aligned with the axis of symmetry and to produce a second alignment mark in the second viewing device at a position being aligned with the axis of symmetry. For continuous alignment the method start over at box 402.

The invention claimed is:

1. A sight system for guiding a missile towards a moving target, the sight system comprising:

a guidance beam generator for generating a guidance beam for the missile to trail the target, at least one of a first viewing device for receiving visible light and a second viewing device for receiving non-visible light radiating from the target, the first viewing device comprising an adjustable first alignment mark configured to be aligned with an axis of the guidance beam, the second viewing device comprising an adjustable second alignment mark configured to be aligned with the axis of the guidance beam, a collimator for aligning at least one of the first alignment mark and the second alignment mark with the axis of the guidance beam, wherein the collimator comprises a light source and a guidance beam detector arranged together in one common position, the guidance beam detector configured to detect the guidance beam, the light source being configured to be detected in at least one of the first viewing device for alignment of the first alignment mark with the axis of the guidance beam and the second viewing device for alignment of the second alignment mark with the axis of the guidance beam, and a unit configured to calculate the position of the axis of the guidance beam in relation to the guidance beam detector.

2. The sight system according to claim 1, wherein the light source comprises at least one of a visible light source producing visible light with a wavelength detectable by the first viewing arrangement and a non-visible light source producing light with a wavelength that can be detected by the second viewing device.

3. The sight system according to claim 1, wherein the light source and the guidance beam detector is a photodiode that is configured to produce at least one of visible light and non-visible light when biased in one direction and configured to detect light when biased in the opposite direction.

4. The sight system according to claim 1, wherein the light source and the guidance beam detector is a photodiode that is configured to produce visible light when biased in one direction and configured to detect light when biased in the opposite direction.

5. The sight system according to claim 4, wherein the non-visible light is infrared light and the non-visible light source is a heat radiation device.

6. The sight system according to claim 1, further comprising:

a mirror arrangement configured to guide the guidance beam from the guidance beam generator to the beam detector in the collimator and configured to guide the light from the light source in the collimator to at least one of the first viewing device and the second viewing device.

7. The sight system according to claim 6, wherein the minor arrangement configured to guide the guidance beam from the guidance beam generator to an exit opening in the sight system to direct the guidance beam towards the target.

8. The sight system according to claim 6, wherein the mirror arrangement is configured to guide light radiating from the target to at least one of the first viewing device and the second viewing device.

9. The sight system according to claim 6, wherein the minor arrangement comprises a plurality of minors and at least one of the mirrors is partially reflective.

10. The sight system according to claim 1, wherein the first viewing device comprises a camera for visible light.

11. The sight system according to claim 1, wherein the second viewing device comprises a camera for non-visible light.

12. The sight system according to claim 1, further comprising:

a control unit configured to control the position of at least one of the first alignment mark in the first viewing device and the second alignment mark in the second viewing device.

13. The sight system according to claim 12, wherein the control unit is configured to communicate with the collimator and wherein the guidance beam generator and at least one of the first viewing device and the second viewing device for adjusting at least one of the first alignment mark and the second alignment mark into alignment with the axis of the guidance beam.

14. The sight system according to claim 12, wherein the control unit is configured to pass at least one of an image from the first viewing device and an image from the second viewing device to a remote display unit.

15. The sight system according to claim 12, wherein the control unit is configured to pass the image from the second viewing device to a display unit being used by the first viewing device to aid in directing the guidance beam at the target under conditions of reduced visibility.

16. The sight system according to claim 1, further comprising:

a symbol generator for generating at least one of the first alignment mark and the second alignment mark.

17. The sight system according to claim 16, wherein the control unit is configured to control the symbol generator to present the first alignment mark in at least one of the first viewing device and the second alignment mark in the second viewing device.

18. The sight system according to claim 1, wherein the first viewing device is an optical sight.

19. The sight system according to claim 18, wherein the control unit is configured to pass an image from the second viewing device to the optical sight for viewing in order to aid in directing the guidance beam at the target under conditions of reduced visibility.

20. The sight system according to claim 1, wherein the axis is the axis of symmetry of the guidance beam.

21. The sight system according to claim 1, wherein the guidance beam comprises a number of laser beams sweeping over a selected area.

22. The sight system according to claim 1, wherein the non-visible light is ultraviolet light and the non-visible light source is a source of ultraviolet light.

23. The sight system according to claim 1, wherein the unit configured to calculate the position of the axis of the guidance beam comprises a control unit.

24. The sight system according to claim 1, wherein the unit configured to calculate the position of the axis of the guidance beam comprises a separate calculating unit operatively connected to a control unit.

25. A method for aligning a sight system for guiding a missile towards a moving target, the method comprising:

generating with a guidance beam generator a guidance beam for the missile to trail the target, receiving at least one of visible light radiating from the target with a first viewing device that receives visible light and receiving non-visible light radiating from the target with a second viewing device that receives non-visible light, and adjusting at least one of an adjustable first alignment mark included in the first viewing device into alignment with an axis of the guidance beam, and an adjustable second alignment mark included in the second viewing device into alignment with the axis of the guidance beam, wherein at least one of the first alignment mark and the second alignment mark are aligned with the axis of the guidance beam with a collimator comprising a light source and a guidance beam detector configured together in one common position, wherein the guidance beam detector detects the guidance beam for calculating the position of the axis of the guidance beam in relation to the beam detector, and wherein the light source is detected in at least one of the first viewing device and in the second viewing device for alignment of at least one of the first alignment mark and the second alignment mark with the axis of the guidance beam.

26. The method for a sight system according to claim 25, wherein the light source comprises a visible light source producing at least one of a visible light with a wavelength detectable by the first viewing arrangement and a non-visible light source producing light with a wavelength that can be detected by the second viewing device.

27. The method for a sight system according to claim 25, wherein the light source and the guidance beam detector comprises a photodiode that produces at least one of visible light and non-visible light when biased in one direction and that detects light when biased in the opposite direction.

28. The method for a sight system according to claim 25, wherein the light source and the guidance beam detector comprise a photodiode that produces visible light when biased in one direction and that detects light when biased in the opposite direction.

29. The method for a sight system according to claim 28, wherein the non-visible light is infrared light and the non-visible light source comprises a heat radiation device.

30. The method according to claim 25, wherein the non-visible light is ultraviolet light and the non-visible light source is a source of ultraviolet light.

* * * * *